US012114765B2

(12) United States Patent
Vilinsky et al.

(10) Patent No.: US 12,114,765 B2
(45) Date of Patent: Oct. 15, 2024

(54) MANUAL TOOTHBRUSH FOR ANIMALS

(71) Applicant: Keen Products Inc., King City (CA)

(72) Inventors: Gary Vilinsky, King City (CA); Christopher J. Pearen, Brampton (CA); Bartek Zalewski, Richmond Hill (CA); Paul Cira, Toronto (CA)

(73) Assignee: Keen Products Inc., King City (CA)

( * ) Notice: Subject to any disclaimer, the term of this patent is extended or adjusted under 35 U.S.C. 154(b) by 96 days.

(21) Appl. No.: 17/472,155

(22) Filed: Sep. 10, 2021

(65) Prior Publication Data

US 2023/0078068 A1 Mar. 16, 2023

(51) Int. Cl.
*A46B 5/00* (2006.01)
*A46B 9/04* (2006.01)

(52) U.S. Cl.
CPC ..... *A46B 5/0016* (2013.01); *A46B 9/04* (2013.01); *A46B 2200/1086* (2013.01)

(58) Field of Classification Search
USPC ..... 15/167.1
See application file for complete search history.

(56) References Cited

U.S. PATENT DOCUMENTS 2,251,853 A * 8/1941 Abraham ..... A46B 5/0016 15/176.4
2,934,776 A * 5/1960 Clemens ..... A46B 5/0095 15/167.1
4,150,457 A * 4/1979 Larson ..... A46B 5/0016 15/167.1
4,454,623 A * 6/1984 O'Halloran ..... A46B 9/04 D4/111
4,524,478 A * 6/1985 Ross ..... A46B 9/04 40/314
D289,286 S 5/1987 Tapocik
4,679,272 A * 7/1987 Florence ..... A46B 9/04 15/176.3
4,738,001 A * 4/1988 Shipp ..... A46B 9/04 15/167.1
4,763,375 A * 8/1988 Vieten ..... A46B 9/026 15/176.1
5,522,109 A 6/1996 Chan
6,292,973 B1 * 9/2001 Moskovich ..... A46B 5/0066 D4/138
D658,888 S * 5/2012 Prochaska ..... D4/105
(Continued)

*Primary Examiner* — Bryan R Muller
*Assistant Examiner* — Dana Lee Poon
(74) *Attorney, Agent, or Firm* — Sand, Sebolt & Wernow Co., LPA

(57) ABSTRACT

A manual toothbrush that includes a handle, a first brush head, and a second brush head. The handle has a first end, a second end opposite to the first end, a grip disposed between the first and second ends of the handle, and a longitudinal axis extending through the grip, wherein each of the first and second ends is offset to the longitudinal axis. The first brush head is provided at the first end of the handle, the first brush head has a first set of bristles, the first brush head is disposed at a first angle measured relative to the longitudinal axis of the handle. The second brush head is provided at the second end of the handle, the second brush head has a second set of bristles, the second brush head is disposed at a second angle measured relative to the longitudinal axis of the handle.

16 Claims, 10 Drawing Sheets

(56) References Cited

U.S. PATENT DOCUMENTS

| | | | | |
|---|---|---|---|---|
| 2004/0025272 | A1* | 2/2004 | Stvartak | A46B 5/02 15/167.1 |
| 2004/0094180 | A1 | 5/2004 | Hsu | |
| 2004/0128779 | A1* | 7/2004 | Chan | A61C 17/225 15/22.1 |
| 2005/0071939 | A1 | 4/2005 | Wong | |
| 2005/0138744 | A1* | 6/2005 | Hohlbein | A46B 9/028 15/201 |
| 2019/0200744 | A1* | 7/2019 | Jimenez | A46B 9/06 |

* cited by examiner

MANUAL TOOTHBRUSH FOR ANIMALS

TECHNICAL FIELD

This disclosure is directed generally to dental products. More particularly, the disclosure is directed to a manual toothbrush with two brush heads and a grip. Specifically, the disclosure is directed to a manual toothbrush for animals that includes a first brush head disposed at a first end of the toothbrush facing in a first direction, a second brush head disposed at an opposing second end of the toothbrush facing is a second opposing direction, and a grip disposed between the first and second brush heads.

BACKGROUND

Animal dental care and hygiene is an essential part of an animal's overall health. Routine dental care and hygiene for an animal is crucial for preventing the development of dental diseases. Such negligence of providing routine dental care and hygiene to an animal may negatively affect other systems in the animal or may lead to tooth loss later in the animal's life. As such, an animal's dental care and hygiene is important to the animal's overall health and life.

In order to provide such dental care and hygiene to an animal, the use of an animal toothbrush is proper. Conventional animal toothbrushes, however, lack certain technologies that may efficiently and effectively provide dental care and hygiene to an animal. Currently, conventional animal toothbrushes lack the capability of providing multiple brush heads with different head sizes that face in different direction relative to one another. Additionally, the multiple brush heads on these conventional animal toothbrushes fail to provide different angles and/or orientations for bristles to efficiently and effectively clean an animal's teeth. Moreover, the conventional animal toothbrushes fail to provide an additional component that helps to provide dental care and hygiene to an animal's tongue. Furthermore, the conventional animal toothbrushes fail to provide a central gripping location along the handle of the toothbrush that provides support and grip to a user's digits while using the toothbrush on an animal's mouth.

SUMMARY

Based on the conventional technology and current problems in the field of this invention as to providing dental care and hygiene to an animal, an improvement is needed In one aspect, an exemplary embodiment of the present disclosure may provide a manual toothbrush. The manual toothbrush includes a handle, a first brush head, and a second brush head. The handle has a first end, a second end that is opposite to the first end, a grip that is disposed between the first and second ends of the handle, and a longitudinal axis that extends through the grip, and each of the first and second ends is offset to the longitudinal axis. The first brush head is provided at the first end of the handle. The first brush head includes a first set of bristles, and the first brush head is disposed at a first angle that is measured relative to the longitudinal axis of the handle. The second brush head is provided at the second end of the handle. The second brush head includes a second set of bristles, and the second brush head is disposed at a second angle that is measured relative to the longitudinal axis of the handle.

In another aspect, an exemplary embodiment of the present disclosure may provide a manual toothbrush. The manual toothbrush includes a handle, a first brush head, and a second brush head. The handle has a first end, a second end that is opposite to the first end, a grip that is disposed between the first and second ends of the handle, and a longitudinal axis that extends through the grip, and each of the first and second ends is offset to the longitudinal axis. The first brush head is provided at the first end of the handle. The first brush head includes a first set of bristles, and the first brush head is disposed at a first angle that is measured relative to the longitudinal axis of the handle. The second brush head is provided at the second end of the handle. The second brush head includes a second set of bristles, and the second brush head is disposed at a second angle that is measured relative to the longitudinal axis of the handle. The first angle of the first brush head and the second angle of the second brush head are congruent angles.

In another aspect, and exemplary embodiment of the present disclosure may provide a manual toothbrush. The manual toothbrush includes a handle, a first brush head, and a second brush head. The handle has a first end, a second end opposite to the first end, a grip that is disposed between the first and second ends of the handle, and a longitudinal axis that extends through the grip, and each of the first and second ends is offset to the longitudinal axis. The first brush head is provided at the first end of the handle. The first brush head includes a first end, a second end that is disposed opposite to the first end, a first length measured from the first end of the first brush head to the second end of the first brush head, and a first set of bristles. The first brush head is disposed at a first angle that is measured relative to the longitudinal axis of the handle. The second brush head is provided at the second end of the handle. The second brush head includes a first end, a second end that is disposed opposite to the first end, a second length measured from the first end of the second brush head to the second end of the second brush head, and a second set of bristles. The second brush head is disposed at a second angle that is measured relative to the longitudinal axis of the handle. The first angle of the first brush head and the second angle of the second brush head are congruent angles. The second length of the second brush head is greater than the first length of the first brush head. The grip has a first curvilinear wall that extends into the handle and a first circumferential wall that extends from the handle, the first curvilinear wall and the first circumferential wall collectively define a first recess. The grip also has a second curvilinear wall that extends into the handle towards the first circumferential wall and a second circumferential wall that extends from the handle, the second curvilinear wall and the second circumferential wall collectively define a second recess.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
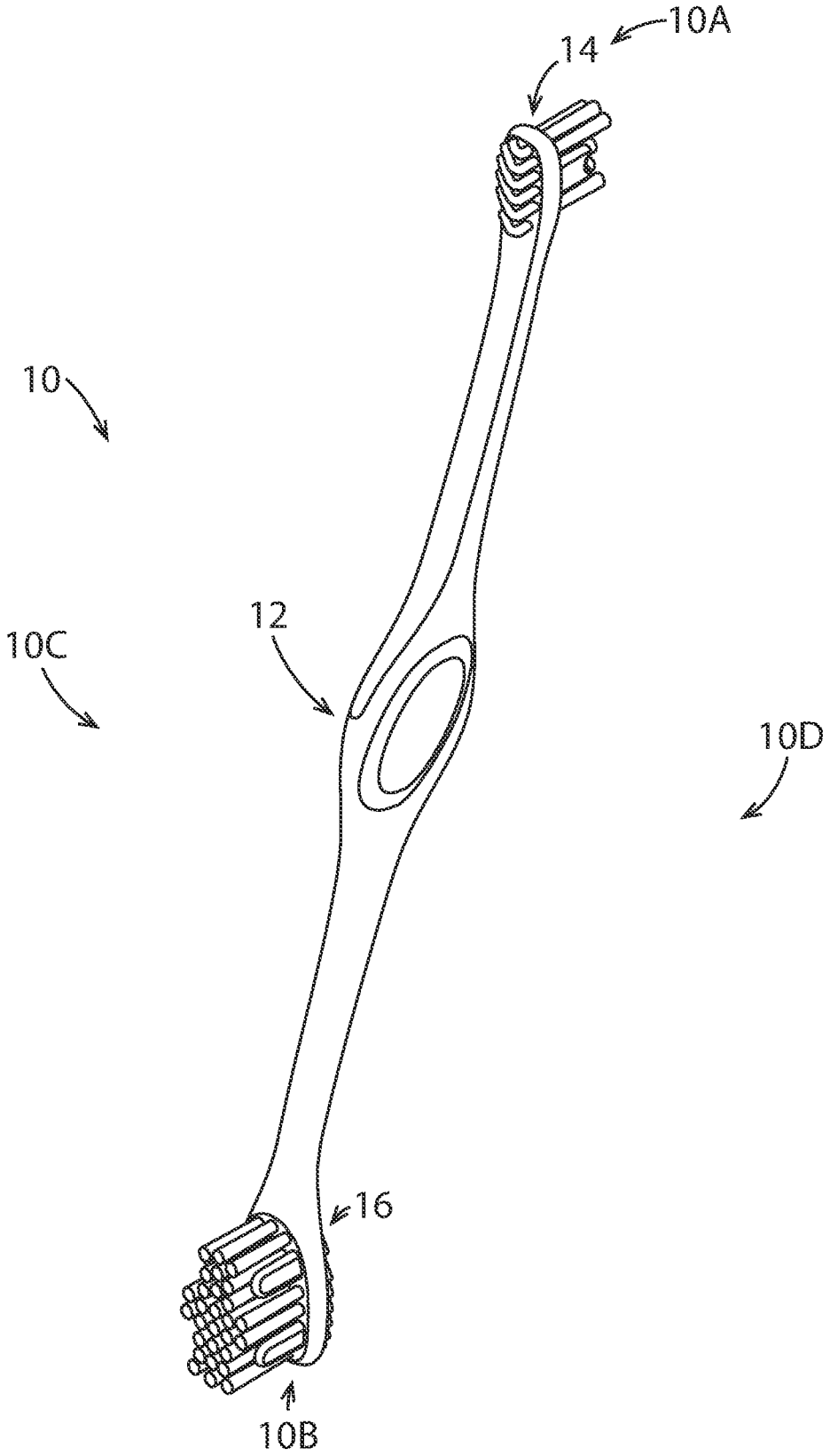
FIG. 1 is a perspective view of the manual toothbrush.

FIG. 1 illustrates a manual toothbrush 10. The manual toothbrush 10 includes a handle 12, a first brush head 14, and a second brush head 16. The manual toothbrush includes a top end 10A, a bottom end 10B that opposes the top end 10A, a left side 10C, and a right side 10D that opposes the left side 10C. The directions of "top," "bottom," "right," and "left" are only used as a directional reference for the manual toothbrush 10 as illustrated in FIG. 1. The directions of "top," "bottom," "right," and "left" may change during operation of the manual toothbrush 10.

Figure 2A:
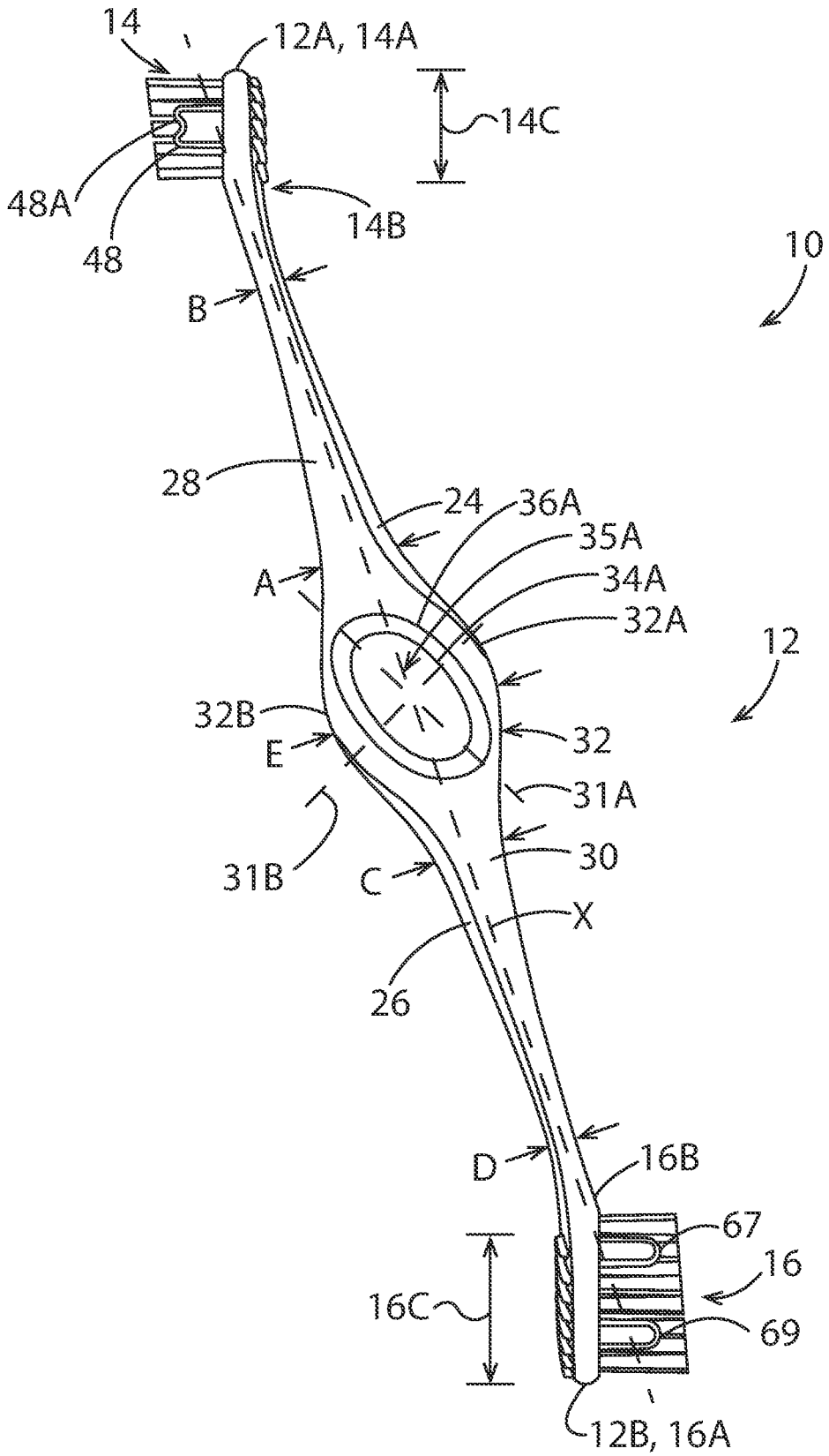
FIG. 2A is left side view of the manual toothbrush.
Figure 2B:
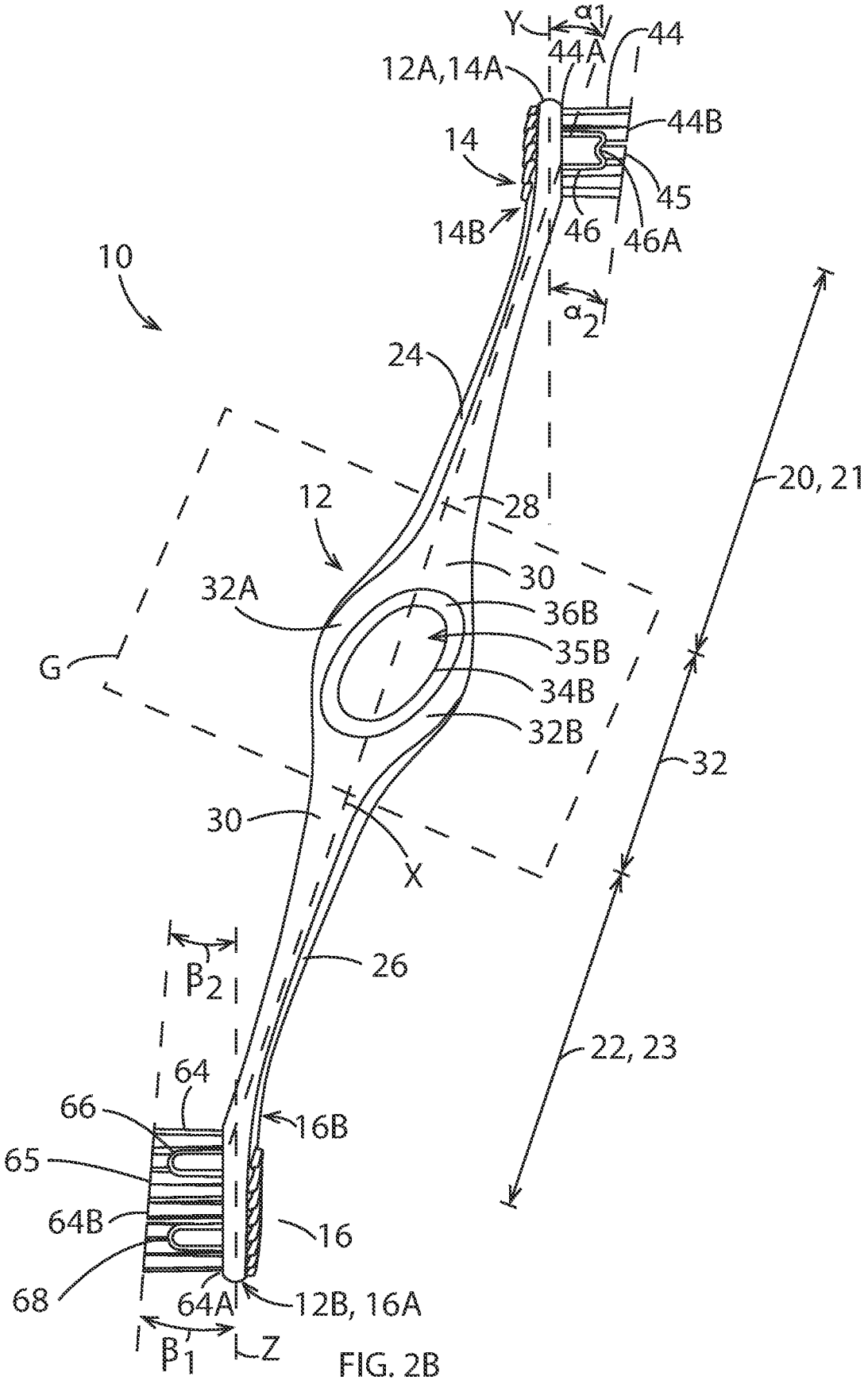
FIG. 2B is a right side view of the manual toothbrush.

As illustrated in FIGS. 2B, the handle 12 has a handle first end 12A, a handle second end 12B that is disposed opposite to the handle first end 12A, and a longitudinal axis "X" where each of the handle first end 12A to the handle second end 12B is offset to the longitudinal axis "X". The first brush head 14 is disposed at the first end 12A of the handle 12, and the second brush head 16 is disposed at the second end 12B of the handle 12. The handle 12 includes a first portion 20 that extends from the first brush head 14 towards the handle second end 12B and defines a first portion length 21. The handle 12 also includes a second portion 22 that extends from the second brush head 16 towards the handle first end 12A and defines a second portion length 23. In one exemplary embodiment, the first portion length 21 and the second portion length 23 may be of equal lengths. In another exemplary embodiment, the first portion length 21 may be greater than the second portion length 23. In another exemplary embodiment, the first portion length 21 may be less than the second portion length 23.

As illustrated in FIGS. 2A and 2B, the first portion 20 includes a first handle surface 24 that is disposed along the longitudinal axis "X" of the handle 12 and extends from the first end 12A of the handle 12 to a location between the first and second ends 12A, 12B of the handle 12. The second portion 22 includes a second handle surface 26 that disposed along the longitudinal axis "X" of the handle 12 and extends from the second end 12B of the handle 12B to a location between the first and second ends 12A, 12B of the handle 12. The first handle surface 24 and the second handle surface 26 oppose each other relative to the longitudinal axis "X" of the handle 12. In addition, the first portion 20 includes a third handle surface 28 that is disposed circumferentially about the longitudinal axis "X" of the handle 12 and extends from the first end 12A of the handle 12 to a location between the first and second ends 12A, 12B of the handle 12. In the illustrated embodiment, the third handle surface 28 is disposed adjacent to the first handle surface 24 on the first portion 20. Moreover, the second portion 22 includes a fourth handle surface 30 that is disposed circumferentially about the longitudinal axis "X" of the handle 12 and extends from the second end 12B of the handle 12 to a location between the first and second ends 12A, 12B of the handle 12. In the illustrated embodiment, the fourth handle surface 28 is disposed adjacent to the second handle surface 26 on the second portion 22.

As illustrated in FIGS. 2A through 4, the first handle surface 24 of the first portion 20 may be a substantially flat surface with curvilinear or rounded edges where the third handle surface 28 meets the edges of first handle surface 24. Similarly, the second handle surface 26 of the second portion 22 may be a substantially flat surface with curvilinear or rounded edges where the fourth handle surface 30 meets the edges of the second handle surface 26. The substantially flat surfaces of the first handle surface 24 and the second handle surface 26 provide an ergonomic benefit that may present additional support to a user's hand when grasping and holding the manual toothbrush while performing dental care on an animal's teeth. In addition, the third and fourth handle surfaces 28, 30 are continuous with each other between the first and second ends 12A, 12B of the handle 12 such that the third and fourth handle surface 28, 30 are integral with each other and define a single, continuous surface along the handle 12. The third and fourth handle surfaces 28, 30 may also be of a substantially curvilinear or rounded shape. The third and fourth surfaces 28, 30 may be contoured in way that allows the user to grasp and hold the manual toothbrush 10 ergonomically.

In addition, the handle 12 includes a grip 32. The grip 32 is disposed between the first portion 20 and the second portion 22 of the handle 12 near the center of the handle 12. The grip 32 defines a major axis 31A and a minor axis 31B in which the major axis 31A is orthogonal to the minor axis 31B. The major axis 31A is also angularly offset to the longitudinal axis "X" of the handle 12 at an angle Δ. In one exemplary embodiment, the angle Δ can be about 20 degrees. The grip 32 extends radially away from the longitudinal axis "X" of the handle 12 along a plane G that intersects the longitudinal axis "X" of the handle 12 to define a first protrusion 32A and a second protrusion 32B. The first protrusion 32A is disposed between the first and second portions 20, 22 and includes a portion of the handle first surface 26. The second protrusion 32B directly opposes the first protrusion 32A relative to the longitudinal axis "X". The second protrusion 32B is disposed between the first and second portions 20, 22 and includes a portion of the handle second surface 28. In addition, the grip 32 includes a portion of the third and fourth handle surfaces 28, 30 due to the third and fourth handle surface 28, 30 being continuously connected together between the first and second ends 12A, 12B of the handle 12.

As illustrated in FIG. 2A, the grip 32 defines a first curvilinear wall 34A that is disposed on the left side 10C of the manual toothbrush 10 between the first and second protrusions 32A, 32B. The first curvilinear wall 34A extends downwardly into the handle 12 towards the right side 10D of the manual toothbrush 10 and defines a first recess 35A. The first curvilinear wall 34A also defines a convex shape. The convex shape of the first curvilinear wall 34A provides an ergonomic configuration to allow a user to rest and position a first digit (such as a thumb) into the first recess 35A and on the first curvilinear wall 34A while operating the manual toothbrush 10, which is described in more detail below. A first circumferential wall 36A is also disposed circumferentially about the first curvilinear wall 34A and extends upwardly from the handle 12 towards the left side 10C of the manual toothbrush 10. The first circumferential wall 36A helps define the first recess 35A with the first curvilinear wall 34A. The first circumferential wall 36A provides additional support to a first digit of the user such that the user's first digit remains engaged to the first curvilinear wall 34A and inside the first recess 35A while operating the manual toothbrush 10.

As illustrated in FIG. 2B, the grip 32 defines an opposing, second curvilinear wall 34B that is disposed on the right side 10D of the manual toothbrush 10 between the first and second protrusions 32A, 32B. The second curvilinear wall 34B extends downwardly into the handle 12 towards the left side 10C of the manual toothbrush 10 and defines a first recess 35B. The second curvilinear wall 34B also defines a convex shape. The convex shape of the second curvilinear wall 34B provides an ergonomic configuration to allow a user to rest and position a second digit (such as a pointer finger) into the second recess 35B and on the second curvilinear wall 34B while operating the manual toothbrush 10, which is described in more detail below. A second circumferential wall 36B is also disposed circumferentially about the second curvilinear wall 34B and extends upwardly from the handle 12 towards the right side 10D of the handle 12. The second circumferential wall 36B helps define the second recess 35B with the second curvilinear wall 34B. The second circumferential wall 36B provides additional support to the second digit of the user such that the user's second digit remains engaged to the second curvilinear wall 34B and inside the second recess 35B while operating the manual toothbrush 10.

In the illustrated embodiment, the first curvilinear wall 34A and the first circumferential wall 36A face in a first direction, and the second curvilinear wall 34B and the second circumferential wall 36B face in a second, opposing direction. The configuration of the grip 32 is considered advantageous at least because the grip 32 allows a user to grasp and hold the handle 12 of the manual toothbrush 10 with first and second digits during use. The user may apply a suitable pressure to the first and second curvilinear walls 34A, 34B such that the first and second digits of the user's hand are pinching the first and second curvilinear walls 34A, 34B of the grip 32. In addition, the first and second circumferential walls 36A, 36B provide additional lateral support to the first and second digits to prevent the first and second digits from disengaging the first and second curvilinear walls 34A, 34B during operation of the manual toothbrush 10. Furthermore, the first curvilinear wall 34A and the second curvilinear wall 34B may accommodate the user's other digits. When the user operates the manual toothbrush 10 with his/her right hand and selects the first brush head 14, the user's first digit (e.g., the user's thumb) may be disposed within the first recess 35A and contacting the first circumferential wall 34A and a portion of the user's second digit (e.g., the user's pointer finger) may be disposed within the second recess 35B and contacting the second circumferential wall 34B when using the first brush head 14 or second brush head 14, which is described in more detail below. When the user operates the manual toothbrush 10 with his/her left hand and selects the first brush head 14, the user's first digit (e.g., the user's thumb) may be disposed within the second recess 35B and contacting the second circumferential wall 34B and a portion of the user's second digit (e.g., the user's pointer finger) may be disposed within the first recess 35A and contacting the first circumferential wall 34A when using the first brush head 14 or the second brush head 16, which is described in more detail below As illustrated in FIG. 2A, the handle 12 defines a first width A and a second width B along the first portion 20, a third width C and a fourth width D along the second portion 22, and fifth width E along the grip 32. As illustrated in FIG. 2, the first width A of the first portion 20 is disposed between the first and second end 12A, 12B of the handle 12 near the grip 32, and the second width B of the first portion 20 is disposed towards the first end 12A of the handle 12 near the first brush head 14. The first and second widths A, B of the first portion 20 are measured from the first handle surface 24 to the third handle surface 28. The first width A is greater than the second width B due to the width of the first portion 20 tapering from the grip 32 and gradually reducing towards the first end 12A of handle 12. Similarly, the third width C of the second portion 22 is disposed between the first and second end 12A, 12B of the handle 12 near the grip 32, and the fourth width D of the second portion 22 is disposed towards the second end 12B of the handle 12 near the second brush head 16. The third and fourth widths C, D of the second portion 22 are measured from the second handle surface 26 to the fourth handle surface 30. The third width C is greater than the fourth width D due to the width of the second portion 22 tapering from the grip 32 and gradually reducing towards the second end 12B of handle 12. The fifth width E of the grip 32 is measured between the first protrusion 32A to the second protrusion 32B. The fifth width E is greater than the first width A and the third width C on the handle 12.

Figure 4:
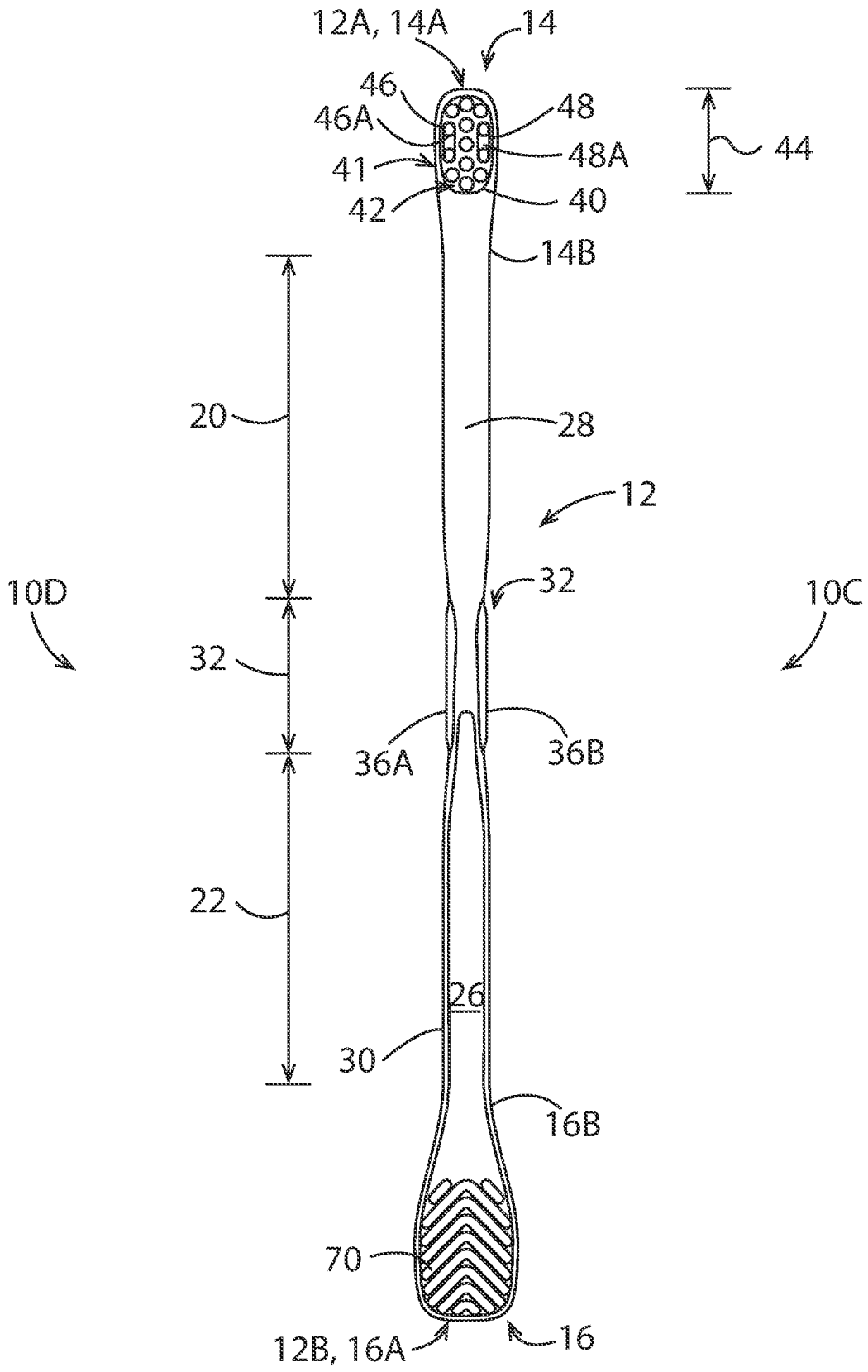
FIG. 4 is a rear view of the manual toothbrush.

The first brush head 14 is disposed at the first end 12A of the handle 12. As illustrated in FIG. 2B, the first brush head 14 is continuous with the handle 12 such that the first brush head 14 is integral with the handle 12. The first brush head 14 defines a first end 14A that is disposed at the first end 12A of the handle 12, a second end 14B opposite to the first end 14 and is disposed between the first end 12A of the handle 12 and the first portion 20, a longitudinal axis "Y" that extends through the first end 14A and the second end 14B of the first brush head 14, and a first head length 14C measured from the first end 14A to the second end 14B. The longitudinal axis "Y" may intersect the plane "G" of the grip 32. As illustrated in FIG. 4, the first brush head 14 also has a circumferential wall 40 that is positioned between the first and second ends 14A, 14B of first brush head 14. The circumferential wall 40 of the first brush head 14 extends downwardly into the handle 12 towards the first handle surface 24 and terminates at a base wall 42. The circumferential surface 40 and the base wall 42 collectively define a recess 41.

As illustrated in FIG. 2B, a portion of the handle 12, which is the first brush head 14, is oriented at a first angle $\alpha_1$. Here, the longitudinal axis "Y" of the first brush head 14 is disposed at the first angle $\alpha_1$ measured relative to the longitudinal axis "X" of the handle 12. The first angle $\alpha_1$ of the first brush head 14 that is measured relative to the handle 12 is of about 20 degrees. The first angle $\alpha_1$ of the first brush head 14 provides a user with the capability of reaching the insides of an animal's teeth, especially the insides of lower and upper front teeth of the animal.

The first brush head 14 also includes a first set of bristles 44 that has a first end 44A and a second end 44B. The first end 44A of the first set of bristles 44 is provided on the base wall 42 and extends outwardly away from the base surface 42, through the recess 41, to the second end 44B of the first set of bristles 44. The first set of bristles 44 defines a first tapered surface 45 that gradually reduces the length of the first set of bristles 44 from the first end 14A of the first brush head 14 to the second end 14B of the first brush head 14. The first tapered surface 45 is disposed at a second angle $\alpha_2$ measured relative to the longitudinal axis "Y" of the first brush head 14. The second angle $\alpha_2$ of the first tapered surface 45 that is measured relative to the handle longitudinal axis "Y" of the first brush head 14 is of about 10 degrees. In other exemplary embodiments, the first set of bristles 44 provided on the first brush head 14 may be arranged and configured in other suitable designs. Examples of other suitable designs for a first set of bristles provided on a first brush head include flat bristles, multilevel bristles, rippled bristles, angled or converging bristles, spiral bristles, V-shaped bristles, or other suitable designs for a first set of bristles provided on a first brush head based on a particular embodiment.

Figure 5:
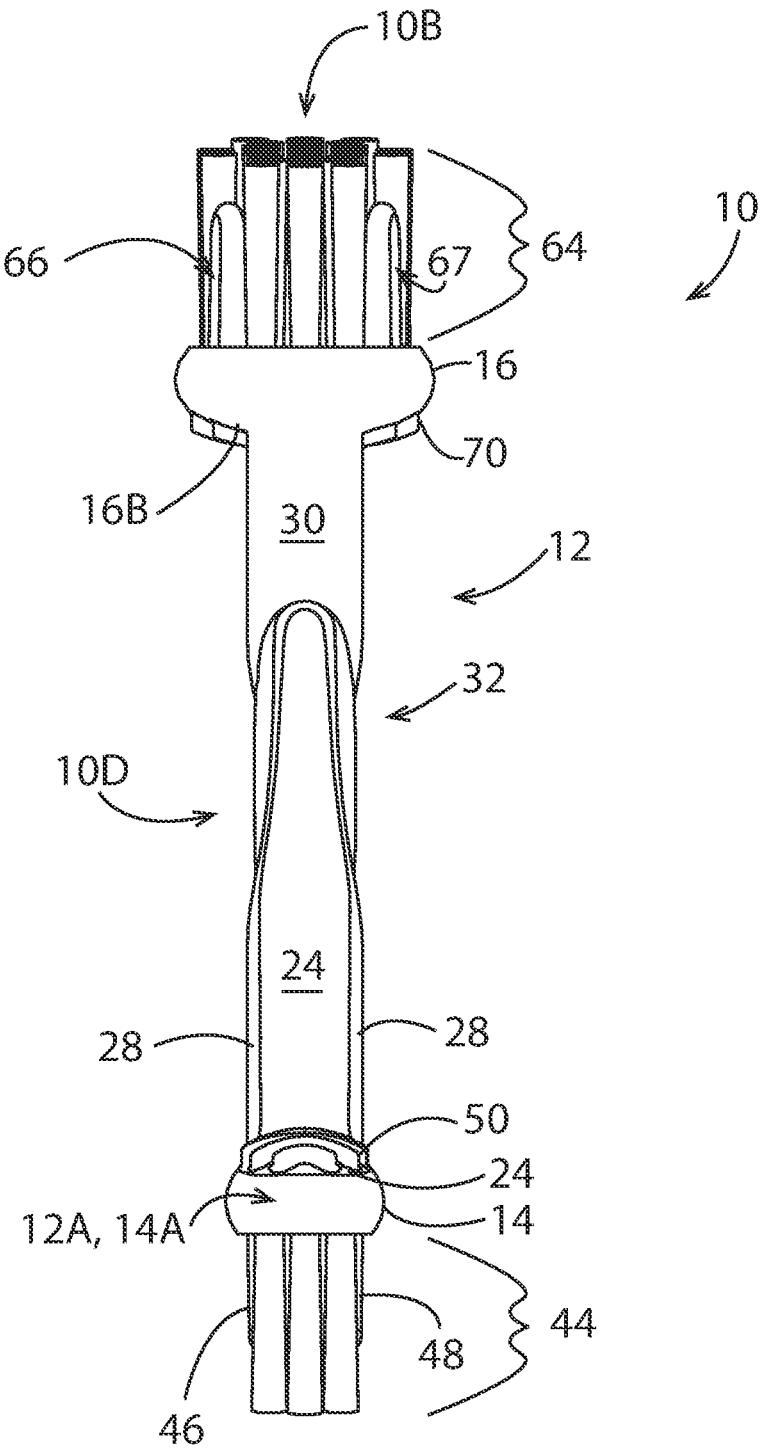
FIG. 5 is a perspective view of the manual toothbrush from a top end of the manual toothbrush.
Figure 6:
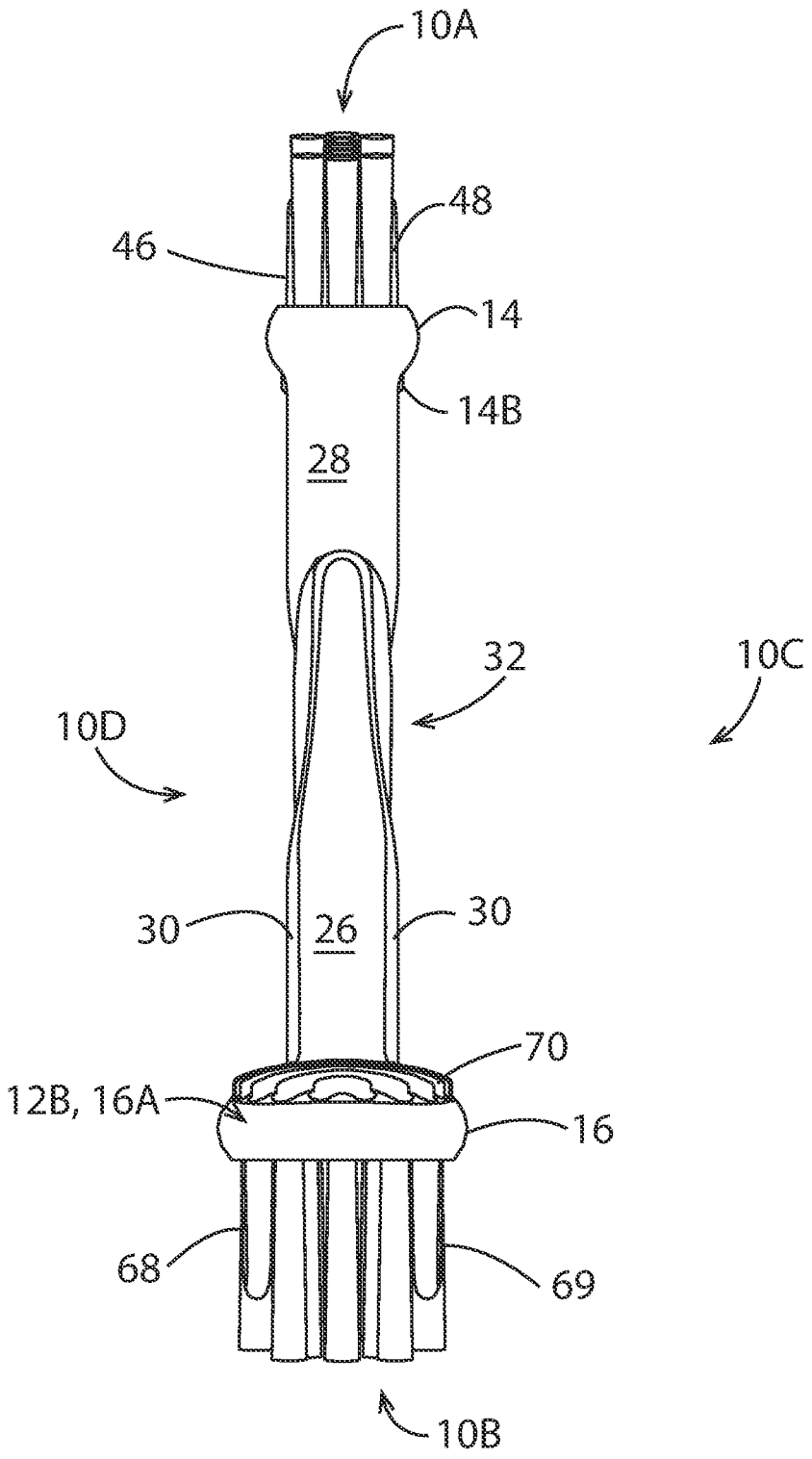
FIG. 6 is a perspective view of the manual toothbrush from a bottom end of the manual toothbrush.

In addition, the first brush head 12 includes a first extension 46 and a second, opposing extension 48. Each of the first and second extensions 46, 48 is provided on the base surface 42 and extends outwardly away from the base surface 42. The first extension 46 is parallel to the second extension 48 on the first brush head 14 and directly oppose one another. As illustrated in FIGS. 4-6, each of the first and second extensions 46, 48 is disposed adjacent to the first set of bristles such that the first extension 46 is disposed between the right side 10D of the manual toothbrush 10 and the first set of bristles 44, and the second extension 48 is disposed between the left side 10C of the manual toothbrush 10 and the first set of bristles 44. Each of the first and second extensions 46, 48 also defines a cavity 46A, 48A that extends downwardly from an end of each of the first and second extensions 46, 48, which is directly opposite to the base surface 42, and into each of the first and second extensions 46, 48 towards the handle 12. Each cavity 46A, 48A of the first and second extensions 46, 48 may be sized and configured to directly contact an animal's tooth to remove dental plaque.

Figure 3:
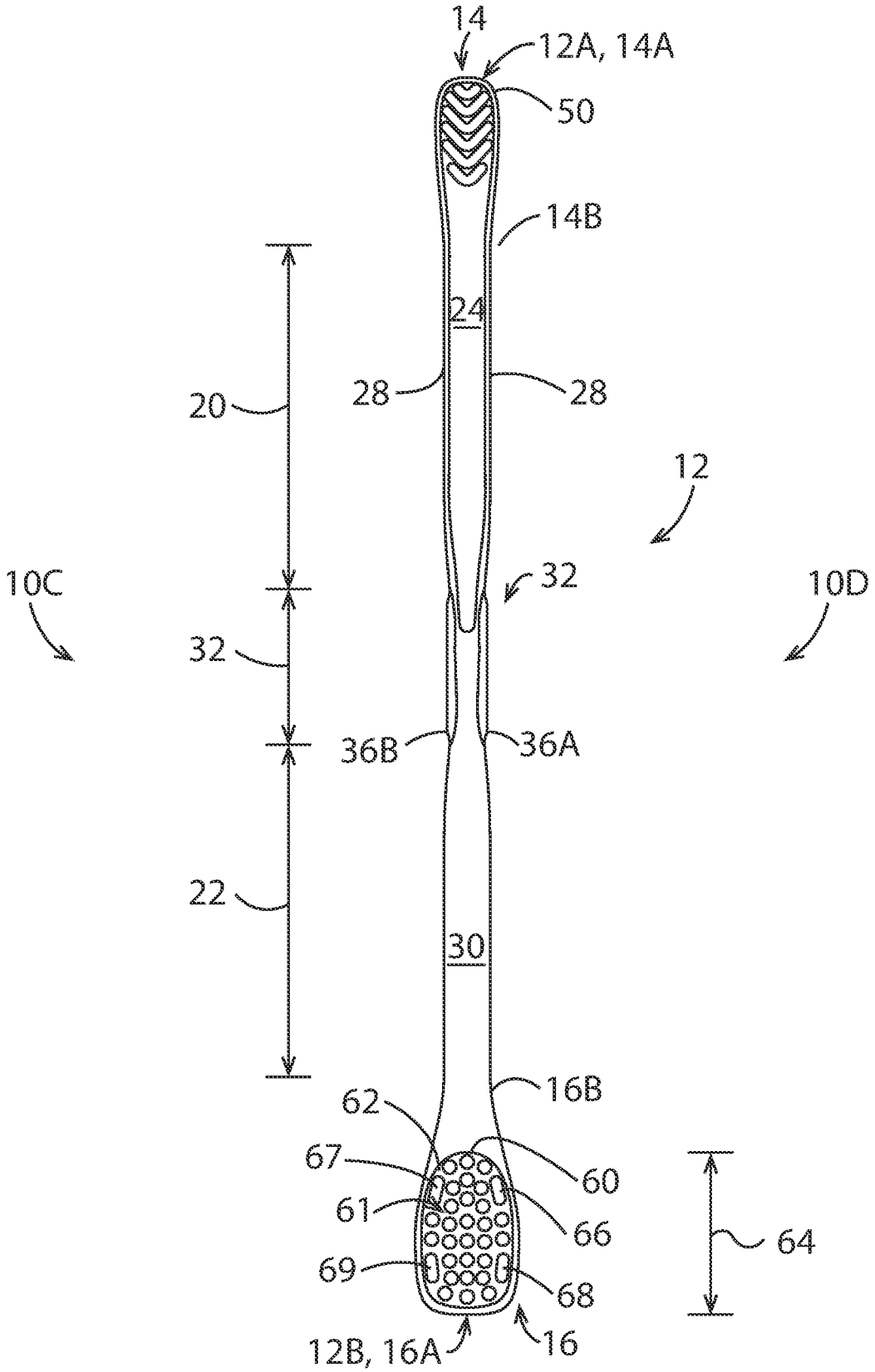
FIG. 3 is a front view of the manual toothbrush.

As illustrated in FIGS. 3 and 5, the first brush head 14 also includes a first set of ridges 50. The first set of ridges 50 is disposed opposite to the first set of bristles 44 and is provided along the first handle surface 24 between the first end 14A of the first brush head 14 to the second end 14B of the first brush head 14. Each ridge of the first set of ridges 50 extends outwardly from the first handle surface 24 and away from the handle 12. In one exemplar embodiment, each ridge of the first set of ridges 50 is substantially V-shaped. The arrangement and configuration of the first set of ridges 50 provides the utility of a tongue cleaner and/or scraper to adequately clean an animal's tongue when a user operates the manual toothbrush 10.

The second brush head 16 is disposed at the second end 12B of the handle 12. As illustrated in FIG. 2B, the second brush head 16 is continuous with the handle 12 such that the second brush head 16 is integral with the handle 12. The second brush head 16 defines a first end 16A that is disposed at the second end 12B of the handle 12, a second end 16B opposite to the first end 16A and is disposed between the second end 12B of the handle 12 and the second portion 22, a longitudinal axis "Z" that extends through the first end 16A and the second end 16B of the second brush head 16, and a second head length 16C measured from the first end 16A to the second end 16B. The longitudinal axis "Z" may intersect the plane "G" of the grip 32. The second brush head 16 has a circumferential wall 60 that is positioned between the first and second ends 16A, 16B of second brush head 16. As illustrated in FIG. 3, the circumferential wall 60 of the second brush head 16 extends downwardly into the handle 12 towards the second handle surface 26 and terminates at a base wall 62. The circumferential wall 60 and the base wall 62 collectively define a recess 61.

As illustrated in FIG. 2, a portion of the handle 12, which is the second brush head 16, is oriented at a third angle $\beta_1$. As such, the longitudinal axis "Z" of the second brush head 16 is disposed at the third angle $\beta_1$ that is measured relative to the longitudinal axis "X" of the handle 12. The third angle $\beta_1$ of the second brush head 16 that is measured relative to the handle 12 is of about 20 degrees. The third angle $\beta_1$ of the second brush head 16 provides a user with the capability of reaching the insides of an animal's teeth, especially the insides of lower and upper front teeth of the animal. In the illustrated embodiment, the first angle $\alpha_1$ of the first brush head 14 is oriented similar to the third angle $\beta_1$ of the second brush head 16 such that the first angle $\alpha_1$ of the first brush head 14 and the third angle $\beta_1$ of the second brush head 16 are congruent angles.

As illustrated in FIGS. 2B and 3, the second brush head 16 also includes a second set of bristles 64 that has a first end 64A and a second end 64B. The first end 64A of the second set of bristles 64 is provided on the base wall 62 and extends outwardly away from the base wall 62, through the recess 61, and to the second end 64B of the second set of bristles 64. The second set of bristles 64 defines a second tapered surface 65 that gradually reduces the length of the second set of bristles 64 from the first end 16A of the second brush head 16 to the second end 16B of the second brush head 16. The second tapered surface 65 is disposed at a fourth angle $\beta_2$ that is measured relative to the longitudinal axis "Z" of the second brush head 16. The fourth angle $\beta_2$ of the second tapered surface 65 that is measured relative to the handle longitudinal axis "Z" of the second brush head 16 is of about 10 degrees. In other exemplary embodiments, the second set of bristles 64 provided on the second brush head 16 may be arranged and configured in other suitable designs. Examples of other suitable designs for a second set of bristles provided on a second brush head include flat bristles, multilevel bristles, rippled bristles, angled or converging bristles, spiral bristles, V-shaped bristles, or other suitable designs for a second set of bristles provided on a second brush head based on a particular embodiment.

As illustrated in FIG. 3, the second brush head 16 includes a first extension 66, a second extension 67, a third extension 68, and a fourth extension 69 provided on the base wall 62 and extend outwardly away from the base wall 62. The first extension 66 is disposed towards the second end 16B of the second brush head 16 and is disposed between the right side 10D of the manual toothbrush 10 and the second set of bristles 64. The second extension 67 is disposed towards the second end 16B of the second brush head 16 and is disposed between the left side 10C of the manual toothbrush 10 and the second set of bristles 64. The third extension 68 is disposed towards the first end 16A of the second brush head 16 and is disposed between the right side 10D of the manual toothbrush 10 and the second set of bristles 64. The fourth extension 69 is disposed towards the first end 16A of the second brush head 16 and is disposed between the left side 10C of the manual toothbrush 10 and the second set of bristles 64. Here, the first extension 66 is parallel to the second extension 67 on the second brush head 16 and directly oppose one another on the second brush head 16. The third extension 68 is parallel to the fourth extension 69 on the second brush head 16 and directly oppose one another on the second brush head 16. The first, second, third, and fourth extensions 66, 67, 68, 69 of the second brush head 16 provide additional cleaning capabilities with the second set of bristles 64 when a user performs dental care on an animal's teeth.

The first brush head 14 also includes a second set of ridges 70. The second set of ridges 70 are disposed opposite to the second set of bristles 64 and is provided along the second handle surface 26 between the first end 16A of the second brush head 16 to the second end 16B of the second brush head 16. Each ridge of the second set of ridges 70 extends outwardly from the second handle surface 26 and away from the handle 12. In one exemplar embodiment, each ridge of the second set of ridges 70 is substantially V-shaped. The arrangement and configuration of the second set of ridges 70 provides the utility of a tongue cleaner and/or scraper to adequately clean an animal's tongue when a user operates the manual toothbrush 10.

In the illustrated embodiment, the first brush head 14 of the manual toothbrush 10 is oriented with the second brush head 16 such that the first brush head 14 mirrors the second brush head 16 of the handle 12. In other words, the first brush head 14 is parallel to the second brush head 16 based on the longitudinal axis "Y" of the first brush head 14 being parallel to the longitudinal axis "Z" of the second brush head 16. In addition, the first tapered surface 45 of the first set of bristles 44 of the first brush head 14 is substantially parallel to the second tapered surface 65 of the second set of bristles 64 of the second brush head 16. Moreover, the first brush head 14 opposes the second brush head 16 in which first brush head 14 and the second brush head 16 are disposed at opposing ends of the handle 12. The first brush head 14 also faces a first direction based on the orientation of the first set of bristles 44 extending away from the first brush head 14, and the second brush head 16 faces a second, opposite direction based on the orientation of the second set of bristles 64 extending away from the second brush head 16.

Furthermore, the size and configuration of the first brush head 14 is different as compared to the second brush head 16. In the illustrated embodiment, the second head length 16C of the second brush head 16 is greater than the first head length 14C of the first brush head 14. In one exemplary embodiment, the second head length 16C of the second brush head 16 may be equal to the first head length 14C of the first brush head 14.

The differences in length between the first brush head 14 and the second brush head 16 also allow for different amounts of bristles and ridges to be provided on the first brush head 14 and the second brush head 16. In one exemplary embodiment, the first set of bristles 44 on the first brush head 14 may include a total of eight bristles, and the second set of bristles 64 on the second brush head 16 may include a total of twenty-eight bristles. In another exemplary embodiment, the first set of ridges 50 on the first brush head 14 may include a total of six ridges, and the second set of ridges 70 on the second brush head 16 may include a total of 10 ridges. As such, the second brush head 16 may include greater amounts of bristles and ridges in comparison to the first brush head 14 for the manual toothbrush 10. The differences in length between the first and second brush heads 14, 16 on the handle 12 is also considered advantageous at least because it provides a user with the capability of using two different brush heads while performing dental care of an animal's teeth. In one instance, the user may select the first brush head 14 for cleaning a single tooth of the animal or for cleaning tight areas inside the animal's mouth. In another instance, the user may select the second brush head 16 for cleaning multiple teeth inside of the animal's mouth.

The orientation of the first and second brush heads 14, 16 on the handle 12 is considered advantageous at least because each of the first and second brush heads 14, 16 provides a user with a suitable angle of brushing the animal's teeth when a user is handling and operating the manual toothbrush 10. The orientation of the first and second brush heads 14, 16 to the grip 32 is also considered advantageous at least because the orientation allows a user to grasp and hold the handle 12 and the grip 32 simultaneously in an ergonomic position when using either the first brush head 14 or the second brush head 16 during operation of the manual toothbrush 10. The first and second curvilinear surfaces 34A, 36A of the grip 32 is also considered advantageous at least because each of the first and second curvilinear surfaces 34A, 36A provides support to the user during operation of the manual toothbrush 10. When the user decides to the use his/her right hand, the user contacts the first curvilinear wall 34A with a first right-hand digit (e.g., the user's thumb) and contacts the second curvilinear wall 36A with a second right-hand digit (e.g., the user's pointer finger) when the user selects to use the first brush head 14 or second brush head 16 to perform dental care on an animal's teeth. When the user decides to the use his/her left hand, the user will contact the second curvilinear wall 34B with a first left-hand digit (e.g., the user's thumb) and contacts the first curvilinear wall 34A with a second left-hand digit (e.g., the user's pointer finger) when the user selects to use either the first brush head 14 or second brush head 16 to perform dental care on an animal's teeth. Furthermore, the configuration of the manual toothbrush 10 provides convenience to the user such that the user may eliminate an additional toothbrush due to the manual toothbrush 10 providing two different brush heads.

Having now described the structure of manual toothbrush 10 and the various components of the manual toothbrush 10, a method of use thereof will now be described.

During performance of dental care of an animal 100, a user, such as a pet owner or one working in the field of veterinary, may select the manual toothbrush 10 that is provided with the handle 12 that includes the first brush head 14 and the second brush head 16. Upon selection of the manual toothbrush 10, the user may then select between either using the first brush head 14 or the second brush head 16 during performance of dental care on the animal's teeth.

Figure 8:
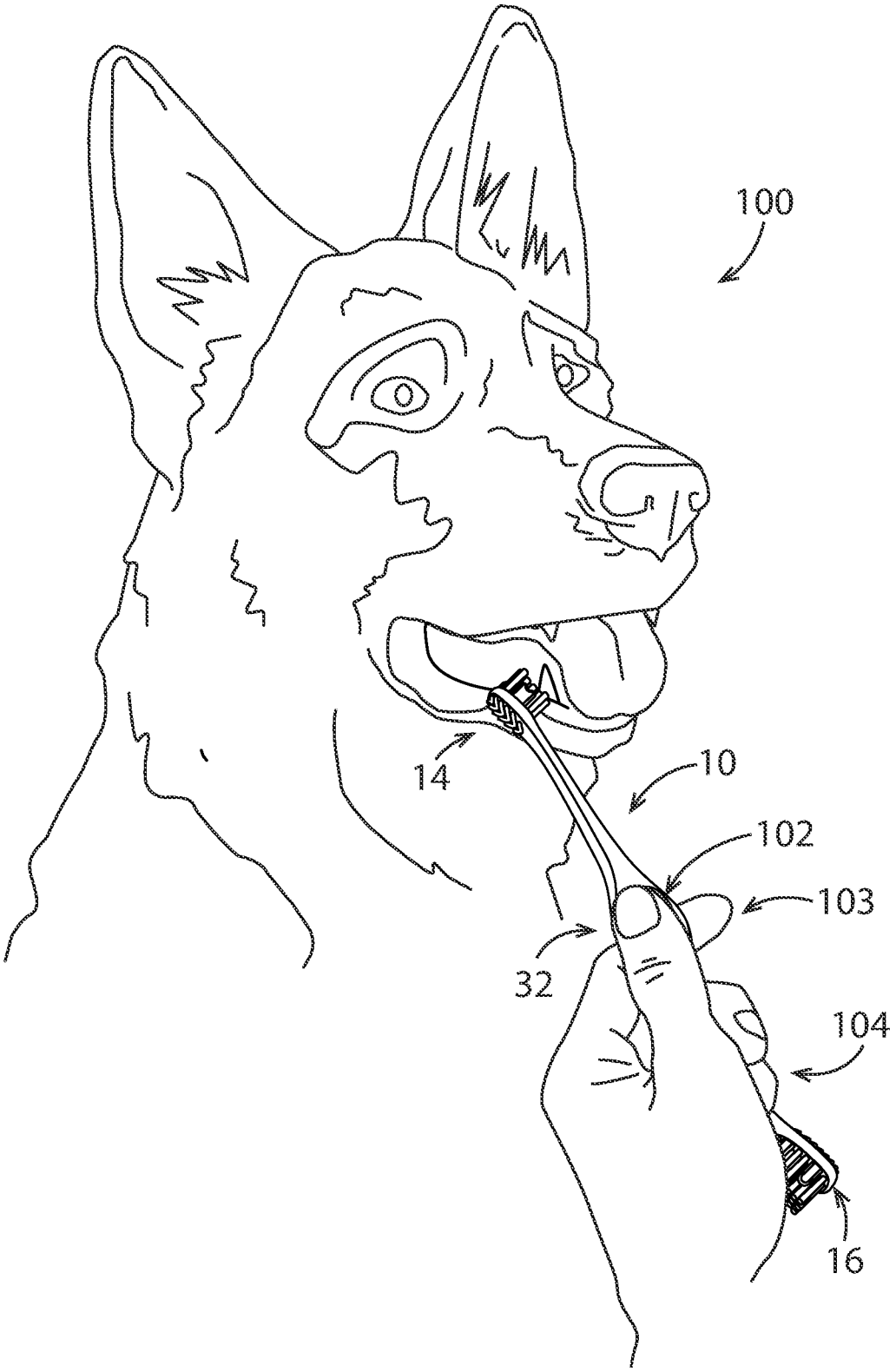
FIG. 8 is a perspective view of a user utilizing the first brush head of the manual toothbrush.

In one instance, the user may select the first brush head 14 on the manual toothbrush 10 for a matter of reasons seen fit during the performance of dental care on the animal's teeth (e.g, cleaning a particular tooth, tight area of cleaning inside the animal's mouth, size of the animal's mouth, etc.). Upon selecting the first brush head 14, the user may grasp and hold the manual toothbrush with his/her left hand along the handle 12 and the grip 32 as illustrated in FIG. 8. In this instance, the user will grasp and hold the grip 32 such that the user contacts the second curvilinear wall 34B of the grip 32 with a first left-hand digit 102 (e.g., the user's thumb) and contacts the first curvilinear wall 34A of the grip 32 with a portion of a second left-hand digit 103 (e.g., the user's pointer finger). The user will then grasp the handle 12 with remaining left-hand digits 104 about the longitudinal axis "X" and along the second portion 22 between the grip 32 and the second brush head 16. Once the manual toothbrush 10 is held by the user, the user may then perform dental care on the animal. During use of the manual toothbrush 10, the user's first left-hand digit 102 will remain inside the second recess 35B of the grip 32 due to the second circumferential wall 36B providing a lateral support structure to the user's first left-hand digit 102 to prevent the first left-hand digit 102 of the user from disengaging the second curvilinear wall 34B of the grip 32.

Figure 9:
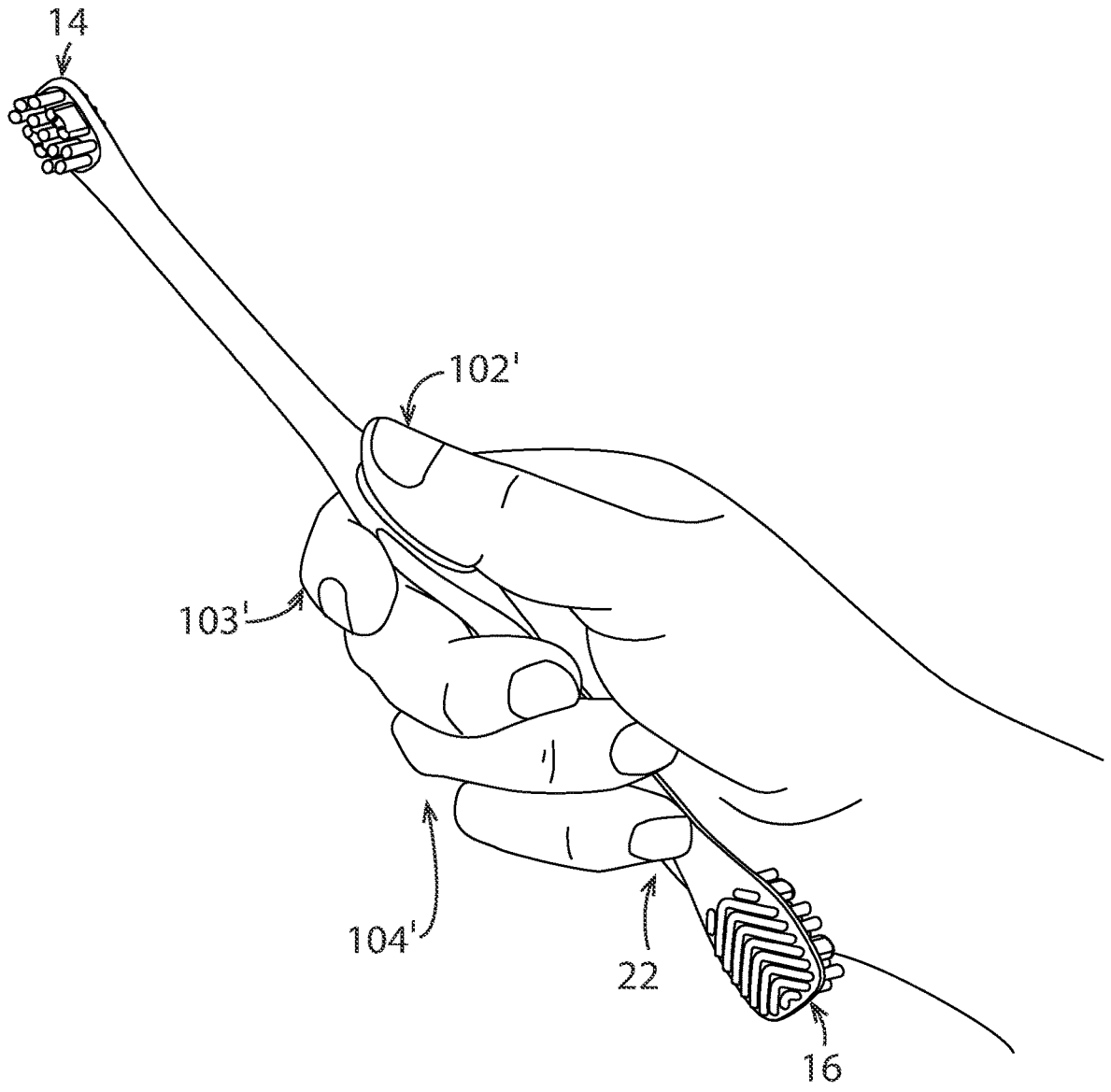
FIG. 9 is a perspective view of a user holding the manual toothbrush and utilizing the first brush head of the manual toothbrush.

As illustrated in FIG. 9, the user may also select the first brush head 14 by holding and grasping to the manual toothbrush with his/her right hand along the handle 12 and the grip 32. In this instance, the user will grasp and hold the grip 32 such that the user contacts the first curvilinear wall 34A of the grip 32 with a first right-hand digit 102' (e.g., the user's thumb) and contacts the second curvilinear wall 34B of the grip 32 with a portion of a second right-hand digit 103' (e.g., the user's pointer finger). The user will then grasp the handle 12 with remaining right-hand digits 104' about the longitudinal axis "X" and along the second portion 22 between the grip 32 and the second brush head 16.

Figure 7:
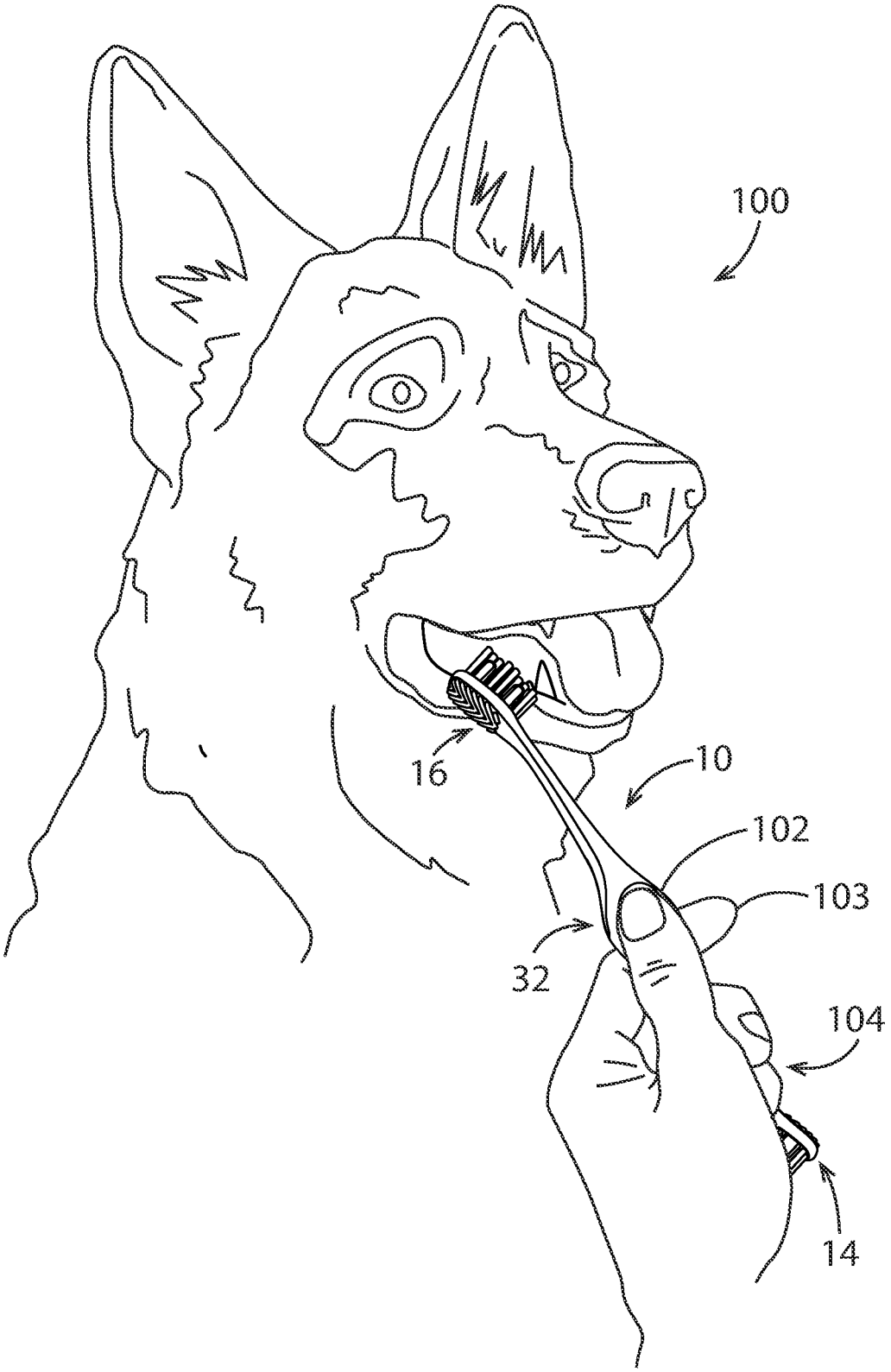
FIG. 7 is a perspective view of a user utilizing the second brush head of the manual toothbrush.

In another instance, the user may select the second brush head 16 prior to performing dental care on the animal's teeth, or the user may switch to the second brush head 16 upon prior usage of the first brush head 14 when performing dental care on the animal's teeth. The user may select the second brush head 16 on the manual toothbrush 10 for a matter of reasons seen fit during the performance of dental care on the animal's teeth (e.g, cleaning multiple teeth, size of the animal's mouth, etc.). Upon selecting the second brush head 16, the user may grasp and hold the manual toothbrush with his/her right or left hand along the handle 12 and the grip 32. In this instance, and as illustrated in FIG. 7, the user may grasp and hold the handle 12 and the grip 32 with his/her left hand similar to selecting the first brush head 14. However, in this instance, the user will grasp the handle 12 with remaining left-hand digits 104 about the longitudinal axis "X" along the first portion 20 between the grip 32 and the first brush head 14. The user may also grasp and hold the manual toothbrush 10 with his/her right hand similar to the grasping and holding the manual toothbrush 10 when the user selected the first brush head 14.

In yet another instance, the user may select to use either the first set of ridges 50, provided on the first brush head 14, or the second set of ridges 70, provided on the second brush head 16, to perform additional dental care on the animal, specifically cleaning the animal's tongue. Upon selecting the first set of ridges 50, the user may grasp and hold the manual toothbrush with either his/her right or left hand along the handle 12 and the grip 32. If the user selects his left-hand, the user will grasp and hold the grip 32 such that the user contacts the first curvilinear wall 34A of the grip 32 with a first left-hand digit (e.g., the user's thumb) and contacts the second curvilinear wall 34B of the grip 34 with a portion of a second left-hand digit (e.g., the user's pointer finger). The user will then grasp the handle 12 with the remaining left-hand digits about the longitudinal axis "X" along the second portion 22 between the grip 32 and the second brush head 16. In another instance, the user may select the second set of ridges 70 on the second brush head 16 and provide a similar grasping and holding technique with his/her left hand when the user selected the first set of ridges 50 on the first brush head 14. In this instance, however, user will grasp the handle 12 with the remaining left-hand digits about the longitudinal axis "X" along the first portion 20 between the grip 32 and the first brush head 14.

During performance of dental care on an animal's teeth, the user may repeat the selection between the first brush head 14, the second brush head 16, the first set of ridges 50, and the second set of ridges 70 for any reason the user sees fit to suitably perform dental care on the animal's teeth. While the user may initially select the first brush head 14 and then select the second brush head 16, the user may select either the first brush head 14 or the second brush head 16 in any order during performance of dental care on the animal's teeth. Moreover, while the user may initially select the first set of ridges 50 and then select the second set of ridges 70, the user may select the first set of ridges 50 and the second set of ridges 70 in any order during performance of dental care on the animal's teeth. Furthermore, the user may initially select either first set of ridges 50 or the second set of ridges 52 prior to selecting the first brush head 14 or the second brush head 16.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of,"

"only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0. % of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A manual toothbrush, comprising;

a handle having a first end, a second end opposite to the first end, a grip disposed between the first and second ends of the handle on a first plane and defining a major axis and a minor axis that intersect at a center point, and a longitudinal axis extending through the grip and intersecting with the center point of the grip, wherein each of the first and second ends is offset to the longitudinal axis, and wherein the handle and the grip define a continuous solid member between the first end and the second end;

a first brush head provided at the first end of the handle and defining a first brush head longitudinal axis that intersects with the first plane, the first brush head having a first set of bristles, the first brush head is disposed at a first angle measured relative to the longitudinal axis of the handle;

a first set of extensions extending outwardly from the first brush head, wherein each extension of the first set of extensions is defined along the first plane that is parallel with the longitudinal axis;

a second brush head provided at the second end of the handle and defining a second brush head longitudinal axis that intersects with the first plane and is parallel with the first brush head longitudinal axis, the second brush head having a second set of bristles, the second brush head is disposed at a second angle measured relative to the longitudinal axis of the handle;

a first curvilinear wall of the grip that extends into the handle and a first circumferential wall of the grip that extends from the handle, wherein the first curvilinear wall and the first circumferential wall collectively define a first recess; and a second curvilinear wall of the grip that extends into the handle and towards the first curvilinear wall and a second circumferential wall of the grip that extends from the handle, wherein the second curvilinear wall and the second circumferential wall oppose the first curvilinear wall and the first circumferential wall and collectively define a second recess that is opposite to and spaced apart from the first recess relative to an axis that intersects the first plane;

wherein the major axis and the minor axis of the grip are free from intersecting the first brush head and the first set of bristles or the second brush head and the second set of bristles.

2. The manual toothbrush of claim 1, wherein the first angle of the first brush head and the second angle of the second brush head are congruent angles.

3. The manual toothbrush of claim 1, wherein the first set of bristles extends outwardly from the first brush head in a first direction; and wherein the second set of bristles extends outwardly from the second brush head in a second direction; and wherein the first direction is directly opposite to the second direction.

4. The manual toothbrush of claim 1, wherein the first set of extensions extends outwardly from the first brush head in the first direction; and wherein the second brush head further comprises a second set of extensions that extends outwardly from the second brush head in the second direction, wherein each extension of the second set of extensions is defined along a second plane that is parallel with the longitudinal axis.

5. The manual toothbrush of claim 1, wherein the first angle of the first brush head is measured at about 20 degrees.

6. The manual toothbrush of claim 1, wherein the first angle of the first brush head is measured at about 20 degrees.

7. The manual toothbrush of claim 1, wherein the first brush head comprises of a first end, a second end that opposes the first end, and a first length that is measured from the first end to the second end;

wherein the second brush head comprises of a first end, a second end that opposes the first end, and a second length that is measured from the first end to the second end; and wherein the second length of the second brush head is greater than the first length of the first brush head.

8. The manual toothbrush of claim 7, wherein the grip further comprises a grip length that is greater than the first length of the first brush head and less than the second length of the second brush head.

9. The manual toothbrush of claim 1, wherein the major axis is angularly offset to the longitudinal axis.

10. The manual toothbrush of claim 1, wherein the grip is configured to allow a portion of a thumb of a user to be disposed within the first recess when using the manual toothbrush.

11. The manual toothbrush of claim 10, wherein the first circumferential wall of the grip is configured to maintain the portion of the thumb of the user inside the first recess.

12. The manual toothbrush of claim 1, wherein the grip is configured to allow a portion of a thumb of a user to be disposed within the second recess when the using the manual toothbrush.

13. The manual toothbrush of claim 12, wherein the second circumferential wall of the grip is configured to maintain the portion of the thumb of the user inside the second recess.

14. The manual toothbrush of claim 1, wherein the grip defines an ovoidal shape.

15. A manual toothbrush, comprising;

a handle having a first end, a second end opposite to the first end, a grip disposed between the first and second ends of the handle on a first plane and defining a major axis and a minor axis that intersect at a center point, and a longitudinal axis extending through the grip and intersecting with the center point of the grip, wherein each of the first and second ends is offset to the longitudinal axis, and wherein the handle and the grip define a continuous solid member between the first end and the second end;

a first brush head provided at the first end of the handle, the first brush head having a first end, a second end disposed opposite to the first end, a first length measured from the first end of the first brush head to the second end of the first brush head, a first brush head longitudinal axis defined between the first end of the first brush head and the second end of the first brush head that intersects with the first plane, and a first set of bristles, the first brush head is disposed at a first angle measured relative to the longitudinal axis of the handle;

a first set of extensions extending outwardly from the first brush head, wherein each extension of the first set of extensions is defined along the first plane that is parallel with the longitudinal axis; and a second brush head provided at the second end of the handle, the second brush head having a first end, a second end disposed opposite to the first end, a second length measured from the first end of the second brush head to the second end of the second brush head, a second brush head longitudinal axis defined between the first end of the second brush head and the second end of the second brush head that intersects with the first plane and is parallel with the first brush head longitudinal axis, and a second set of bristles, the second brush head is disposed at a second angle measured relative to the longitudinal axis of the handle;

wherein the first angle of the first brush head and the second angle of the second brush head are congruent angles; and wherein the second length of the second brush head is greater than the first length of the first brush head;

wherein the grip comprises a first curvilinear wall that extends into the handle and a first circumferential wall that extends from the handle, the first curvilinear wall and the first circumferential wall collectively define a first recess;

wherein the grip further comprises a second curvilinear wall that extends into the handle and towards the first curvilinear wall and a second circumferential wall that extends from the handle, the second curvilinear wall and the second circumferential wall oppose the first curvilinear wall and the first circumferential wall and collectively define a second recess that is opposite to and spaced apart from the first recess relative to an axis that intersects the first plane; and wherein the major axis and the minor axis of the grip are free from intersecting the first brush head and the first set of bristles or the second brush head and the second set of bristles.

16. A manual toothbrush, comprising;

a handle having a first end, a second end opposite to the first end, a grip disposed between the first and second ends of the handle and defining a major axis and a minor axis that intersect at a center point, and a longitudinal axis extending through the grip and intersecting with the center point of the grip, wherein each of the first and second ends is offset to the longitudinal axis, and wherein the handle and the grip define a continuous solid member between the first end and the second end;

a first brush head provided at the first end of the handle, the first brush head having a first set of bristles, the first brush head is disposed at a first angle measured relative to the longitudinal axis of the handle;

a first tapered bristle surface collectively defined along terminal ends of the first set of bristles that are remote from the first brush head, wherein the first set of bristles reduce in length from a first end of the first brush head that is spaced apart from the handle to a second end of the first brush head that is operably engaged with the handle;

a first set of extensions extending outwardly from the first brush head, wherein each extension of the first set of extensions is defined along a first plane that is parallel with the longitudinal axis; and a second brush head provided at the second end of the handle, the second brush head having a second set of bristles, the second brush head is disposed at a second angle measured relative to the longitudinal axis of the handle; and a second tapered bristle surface collectively defined along terminal ends of the second set of bristles that are remote from the second brush head, wherein the second set of bristles reduce in length from a first end of the second brush head spaced apart from the handle to a second end of the second brush head that is operably engaged with the handle;

a first curvilinear wall of the grip that extends into the handle and a first circumferential wall of the grip that extends from the handle, wherein the first curvilinear wall and the first circumferential wall collectively define a first recess; and a second curvilinear wall that the grip that extends into the handle and towards the first curvilinear wall and a second circumferential wall of the grip that extends from the handle, wherein the second curvilinear wall and the second circumferential wall oppose the first curvilinear wall and the first circumferential wall and collectively define a second recess that is opposite to and spaced apart from the first recess relative to an axis that intersects the first plane;

wherein the major axis and the minor axis of the grip are free from intersecting the first brush head and the first set of bristles or the second brush head and the second set of bristles.

* * * * *